US012331926B2

(12) United States Patent
Zhang

(10) Patent No.: US 12,331,926 B2
(45) Date of Patent: Jun. 17, 2025

(54) COMBUSTION DEVICE AND BOILER

(71) Applicant: IHI Corporation, Tokyo (JP)

(72) Inventor: Juwei Zhang, Tokyo (JP)

(73) Assignee: IHI Corporation, Tokyo (JP)

( * ) Notice: Subject to any disclaimer, the term of this patent is extended or adjusted under 35 U.S.C. 154(b) by 648 days.

(21) Appl. No.: 17/148,626

(22) Filed: Jan. 14, 2021

(65) Prior Publication Data

US 2021/0140634 A1 May 13, 2021

Related U.S. Application Data

(63) Continuation of application No. PCT/JP2019/035616, filed on Sep. 11, 2019.

(30) Foreign Application Priority Data

Sep. 11, 2018 (JP) ..... 2018-169624

(51) Int. Cl.
*F23C 1/12* (2006.01)
*F23D 1/00* (2006.01)
*F23K 3/00* (2006.01)

(52) U.S. Cl.
CPC ..... *F23C 1/12* (2013.01); *F23D 1/00* (2013.01); *F23K 3/00* (2013.01)

(58) Field of Classification Search
None
See application file for complete search history.

(56) References Cited

U.S. PATENT DOCUMENTS 2,335,188 A * 11/1943 Kennedy ..... F23D 17/00 431/185
2002/0061271 A1* 5/2002 Zauderer ..... F23D 1/005 423/243.08
2013/0142719 A1 6/2013 Kai et al.
2013/0255551 A1* 10/2013 Xue ..... F23D 1/005 110/297

(Continued)

FOREIGN PATENT DOCUMENTS

CN 115164199 A 10/2022
EP 2 862 621 A1 4/2015
JP 62-60606 B2 12/1987

(Continued)

OTHER PUBLICATIONS

Yukihiko Okumura, "Development of Ammonia Burner with High Intensity Combustion," Abstracts of the Annual Meeting of the Energy Society of Japan , vol. 27, Aug. 1, 2018, pp. 190-191 (with English Abstract).

(Continued)

*Primary Examiner* — Jason Lau
(74) *Attorney, Agent, or Firm* — Oblon, McClelland, Maier & Neustadt, L.L.P.

(57) ABSTRACT

A combustion device is installed in a furnace, is configured to inject and burn ammonia as a fuel, and includes an inner tube nozzle disposed in a center part of the combustion device when viewed in an injection direction of the fuel, and configured to inject the ammonia, and an outer tube nozzle disposed to surround the inner tube nozzle from outside in a radial direction when viewed in the injection direction of the fuel, and configured to inject the ammonia around the inner tube nozzle.

5 Claims, 4 Drawing Sheets

(56) References Cited

U.S. PATENT DOCUMENTS

2015/0068438 A1* 3/2015 Taniguchi ..... F23G 7/10
431/284

FOREIGN PATENT DOCUMENTS

| | | | |
|---|---|---|---|
| JP | 7-310903 | A | 11/1995 |
| JP | 9-89212 | A | 4/1997 |
| JP | 2012-35216 | A | 2/2012 |
| JP | 2014-522 | A | 1/2014 |
| JP | 2016-32391 | A | 3/2016 |
| JP | 2016-130619 | A | 7/2016 |
| JP | 6296216 | B1 | 3/2018 |
| JP | 6332578 | B1 | 5/2018 |
| JP | 2018-138863 | A | 9/2018 |
| JP | 2018-173177 | A | 11/2018 |
| JP | 2018-200144 | A | 12/2018 |
| JP | 2019-86189 | A | 6/2019 |
| JP | 2019-86191 | A | 6/2019 |
| JP | 6880823 | B2 | 6/2021 |
| WO | WO 2012/020557 | A1 | 2/2012 |
| WO | WO 2013/191053 | A1 | 12/2013 |

OTHER PUBLICATIONS

International Search Report issued Nov. 19, 2019 in PCT/JP2019/035616 filed Sep. 11, 2019, 2 pages.

* cited by examiner

COMBUSTION DEVICE AND BOILER

CROSS-REFERENCE TO RELATED APPLICATIONS

This application is a Continuation Applications based on International Application No. PCT/JP2019/035616, filed on Sep. 11, 2019, which claims priority on Japanese Patent Application No. 2018-169624, filed Sep. 11, 2018, the contents of which are incorporated herein by reference.

TECHNICAL FIELD

The present disclosure relates to a combustion device and a boiler.

Background

Patent Document 1 below discloses a complex energy system that burns a fuel containing ammonia. In order to reduce a discharge amount of carbon dioxide, the complex energy system adds ammonia to natural gas serving as a main fuel and burns the fuel containing ammonia.

Document of Related Art

Patent Document

[Patent Document 1] Japanese Unexamined Patent Application, First Publication No. 2016-032391

SUMMARY

When ammonia is burned as a portion of fuel, there is a possibility that nitrogen oxides (NOx) contained in a combustion gas may increase. In a case where a carbon fuel such as natural gas and a nitrogen-containing fuel such as ammonia are burned together, it is necessary to suppress an increase in the nitrogen oxides.

The present disclosure is made in view of the above circumstances, and an object thereof is to suppress an increase in nitrogen oxides in a combustion device and a boiler that burns ammonia as a fuel.

An aspect of the present disclosure is a combustion device which is installed in a furnace, is configured to inject and burn ammonia as a fuel, and includes an inner tube nozzle disposed in a center part of the combustion device when viewed in an injection direction of the fuel, and configured to inject the ammonia, and an outer tube nozzle disposed to surround the inner tube nozzle from outside in a radial direction when viewed in the injection direction of the fuel, and configured to inject the ammonia around the inner tube nozzle.

The combustion device according to the above-described aspect may further include a swirler disposed inside the outer tube nozzle and configured to swirl a flow of the ammonia injected around the inner tube nozzle.

The combustion device according to the above-described aspect may further include a pulverized coal injection nozzle configured to inject air containing pulverized coal around the outer tube nozzle when viewed in the injection direction of the fuel.

In the combustion device according to the above-described aspect, the pulverized coal injection nozzle may be formed of a single tube structure disposed to surround the outer tube nozzle from outside in the radial direction when viewed in the injection direction of the fuel, and configured to guide the air containing the pulverized coal between the pulverized coal injection nozzle and an outer wall surface of the outer tube nozzle.

In the combustion device according to the above-described aspect, the pulverized coal injection nozzle may be formed of a double tube structure having an inner tube and an outer tube, the inner tube being disposed to surround the outer tube nozzle from outside in the radial direction when viewed in the injection direction of the fuel, and the outer tube being disposed to surround the inner tube from outside in the radial direction when viewed in the injection direction of the fuel and configured to guide the air containing the pulverized coal between the inner tube and the outer tube.

Another aspect of the present disclosure is a boiler including the combustion device and a furnace to which the combustion device is attached.

The boiler according to the above-described aspect may further include a first flow rate adjustment part configured to control a flow rate of the ammonia to be supplied to the inner tube nozzle, and a second flow rate adjustment part configured to control a flow rate of the ammonia to be supplied to the outer tube nozzle.

According to the present disclosure, by the ammonia injected from the inner tube nozzle, a reduction region in which the ammonia concentration is high and the oxygen concentration is low is formed in a center part of a flame when viewed in the injection direction of the fuel. On the other hand, nitrogen oxides are generated by burning the mixture of the ammonia injected around the inner tube nozzle from the outer tube nozzle and the oxygen, and the generated nitrogen oxides are carried by a circulating flow flowing from an outer edge of the flame toward a center of the flame, and are supplied to the reduction region. As a result, the nitrogen oxides generated in the outer edge of the flame are reduced in the reduction region, which is formed by the ammonia injected from the inner tube nozzle, to become nitrogen gas ($N_2$). Therefore, according to the present disclosure, it is possible to suppress an increase in the nitrogen oxides.

DESCRIPTION OF EMBODIMENTS

Hereinafter, an embodiment of a combustion device and a boiler according to the present disclosure will be described with reference to the drawings.

First Embodiment

Figure 1:
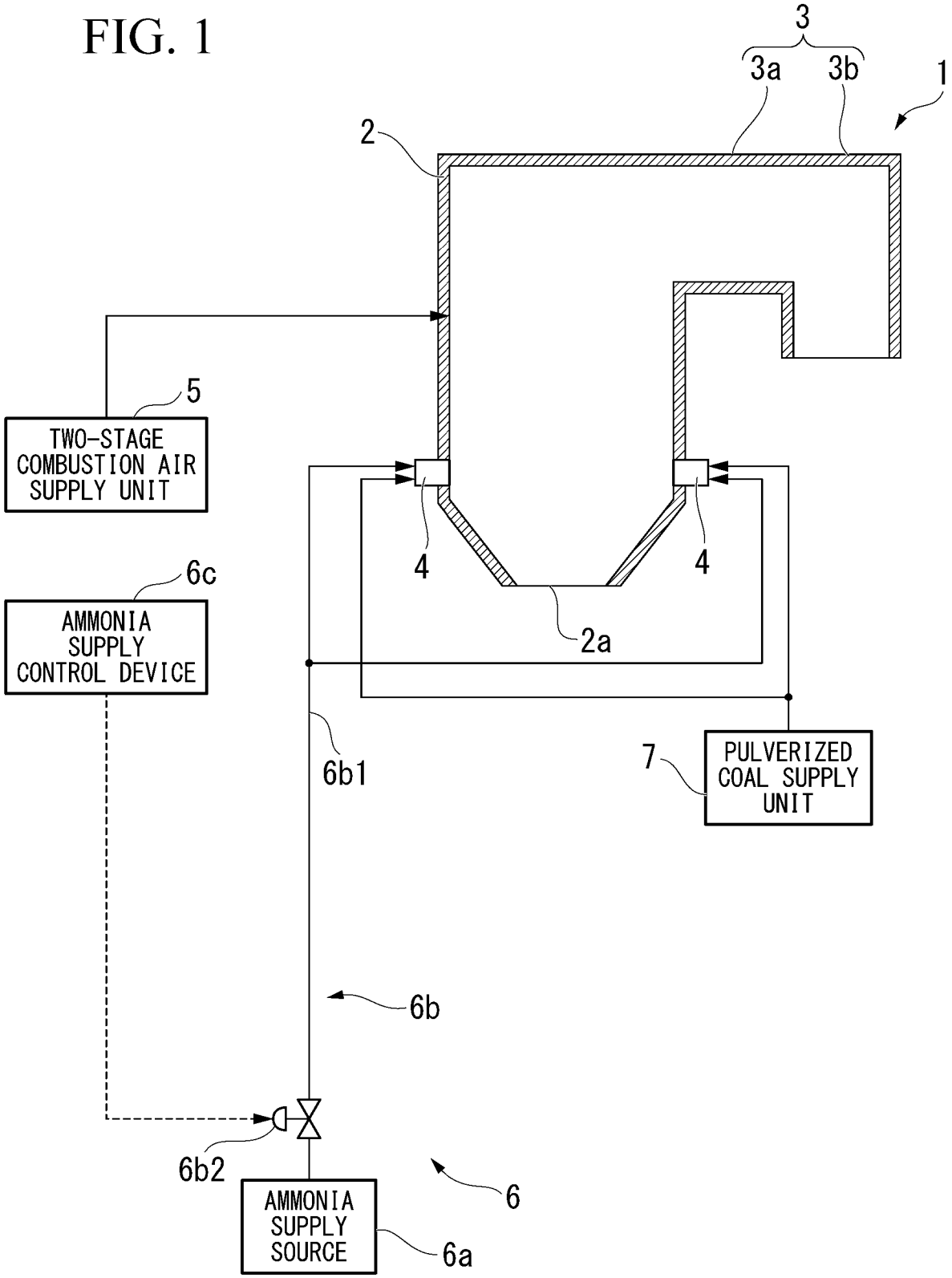
FIG. 1 is a schematic diagram showing a main part configuration of a boiler according to a first embodiment of the present disclosure.

FIG. 1 is a schematic diagram showing a main part configuration of a boiler 1 of a first embodiment. As illustrated in FIG. 1, the boiler 1 includes a furnace 2, a flue 3, burners 4 (combustion device), a two-stage combustion air supply unit 5, an ammonia supply unit 6, and a pulverized coal supply unit 7.

The furnace 2 is a furnace body configured to include a vertically and cylindrically provided furnace wall, and to burn a fuel such as ammonia and pulverized coal to generate combustion heat. In the furnace 2, high-temperature combustion gas is generated by burning the fuel. In addition, a bottom part of the furnace 2 is provided with a discharge port 2*a* through which ash generated by burning the fuel is discharged outward.

The flue 3 is connected to an upper part of the furnace 2, and guides the combustion gas generated in the furnace 2 to the outside as exhaust gas. The flue 3 includes a horizontal flue 3*a* extending horizontally from the upper part of the furnace 2, and a rear flue 3*b* extending downward from an end portion of the horizontal flue 3*a*.

Although omitted in FIG. 1, the boiler 1 includes a superheater installed in the upper part or the like of the furnace 2. The superheater generates steam by exchanging heat between the combustion heat generated in the furnace 2 and water. In addition, although omitted in FIG. 1, the boiler 1 may include a reheater, a fuel economizer, and an air preheater.

The burners 4 are disposed on a wall part in a lower part of the furnace 2. A plurality of the burners 4 are installed in a circumferential direction of the furnace 2. In addition, although omitted in FIG. 1, a plurality of the burners 4 are also installed in a height direction of the furnace 2. The burners 4 are two-dimensionally disposed in the lower part of the furnace 2 and are disposed to face each other, and inject and burn the fuel. All of the burners 4 are composite burners that can inject the ammonia and the pulverized coal as a fuel into the furnace 2.

Although omitted in FIG. 1, the furnace 2 is provided with an ignition device for igniting the fuel (ammonia and pulverized coal) injected into the furnace 2 from the burner 4. In addition, although omitted in FIG. 1, the boiler 1 has a combustion air supply unit that supplies combustion air to the burners 4. The fuel (ammonia and pulverized coal) injected from each of the burners 4 into the furnace 2 together with the combustion air is ignited and burned by an operation of the ignition device.

All of the burners 4 installed in the boiler 1 may not necessarily be the composite burners as described above. For example, a configuration including a coal single-fuel combustion burner or an ammonia single-fuel combustion burner may be adopted.

Here, ammonia ($NH_3$) is a compound of hydrogen (H) and nitrogen (N) as expressed by a molecular formula, and does not contain carbon (C) as a constituent atom. In addition, the ammonia (low carbon fuel) is known as a flame-retardant substance, and is a hydrogen carrier substance having three hydrogen atoms as in methane ($CH_3$). The pulverized coal is obtained by crushing coal which is a fossil fuel to a size of approximately several micrometers, and is generally used as a fuel for the boiler. That is, the ammonia is a low carbon fuel having a lower carbon concentration than the pulverized coal (carbon fuel).

Figure 2:
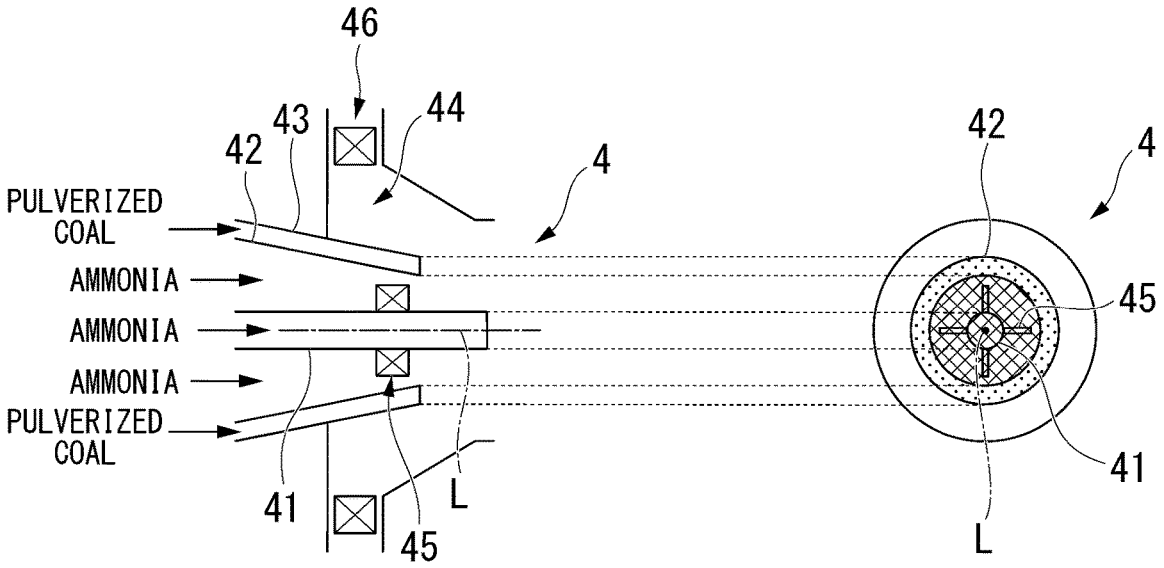
FIG. 2 is a cross-sectional view showing a schematic configuration of a burner included in the boiler according to the first embodiment of the present disclosure.

FIG. 2 is a cross-sectional view showing a schematic configuration of the burner 4. The burner 4 includes an inner tube nozzle 41, an outer tube nozzle 42, and a pulverized coal injection nozzle 43, and is formed in a substantially tubular shape centered on an axis L of the inner cylinder nozzle 41 as a whole. A rear end part of the inner tube nozzle 41 is connected to the ammonia supply unit 6 and injects the ammonia into the furnace 2 from a front end part of the inner tube nozzle 41. The inner tube nozzle 41 is disposed in a center part of the burner 4 when viewed in an injection direction of the ammonia from the burner 4.

The outer tube nozzle 42 is provided coaxially with the inner tube nozzle 41 and is disposed to surround the inner tube nozzle 41 from outside in a radial direction when viewed in the injection direction of the ammonia from the burner 4. A rear end part of the outer tube nozzle 42 is connected to the ammonia supply unit 6 and injects the ammonia around the inner tube nozzle 41 from a front end part of the outer tube nozzle 42.

The pulverized coal injection nozzle 43 is provided concentrically with the inner tube nozzle 41 and the outer tube nozzle 42 and is disposed to surround the outer tube nozzle 42 from outside in the radial direction when viewed in the injection direction of the ammonia from the burner 4. A rear end part of the pulverized coal injection nozzle 43 is connected to the pulverized coal supply unit 7 and injects air containing the pulverized coal into the furnace 2 from a front end part of the pulverized coal injection nozzle 43. That is, in the present embodiment, the pulverized coal injection nozzle 43 is formed of a single tube structure and guides the air containing the pulverized coal between the pulverized coal injection nozzle 43 and an outer wall surface of the outer tube nozzle 42.

The burner 4 further includes a secondary air supply unit 44 disposed to surround the inner tube nozzle 41, the outer tube nozzle 42 and the pulverized coal injection nozzle 43, an ammonia swirler 45 (swirler) disposed inside the outer tube nozzle 42, and an air swirler 46 disposed inside the secondary air supply unit 44. The secondary air supply unit 44 supplies combustion air to a flame from outside thereof in the radial direction.

The ammonia swirler 45 is disposed between the inner tube nozzle 41 and the outer tube nozzle 42. The ammonia swirler 45 is a blade row formed by a plurality of blades arranged in a circumferential direction around the axis L. The ammonia swirler 45 adds a swirling component around the axis L to a flow of the ammonia flowing between the inner tube nozzle 41 and the outer tube nozzle 42. As a result, the ammonia injected from the outer tube nozzles 42 is injected to swirl around the axis L when viewed in the injection direction.

The air swirler 46 is a blade row formed by a plurality of blades arranged in the circumferential direction around the axis L. The air swirler 46 adds a swirling component around the axis L to a flow of the air flowing inside the secondary air supply unit 44. As a result, the air supplied to the furnace 2 from the secondary air supply unit 44 is injected to swirl around the axis L when viewed in the injection direction of the ammonia.

Figure 3:
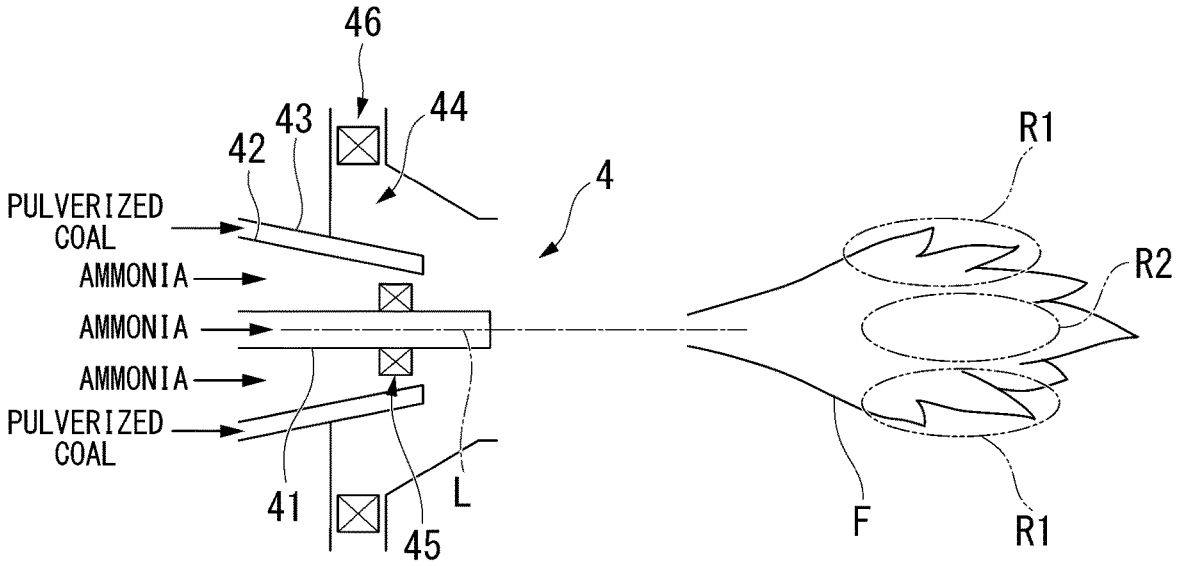
FIG. 3 is a schematic diagram including a flame formed by the burner included in the boiler according to the first embodiment of the present disclosure.

In the burner 4, the ammonia is injected from the inner tube nozzle 41 and the outer tube nozzle 42, the pulverized coal is injected from the pulverized coal injection nozzle 43, and the combustion air is supplied to the burner 4, thereby forming a flame F in front of the burner 4 as shown in FIG. 3. When the flame F is formed, a nitrogen oxide generation region R1 in which many nitrogen oxides are generated is formed in an outer edge region (a region outside the inner tube nozzle 41 in the radial direction of the axis L) of the flame F due to the active reaction between the nitrogen (N) contained in the ammonia with the oxygen (O) contained in the air. Further, a reduction region R2 in which the ammonia concentration is high and the oxygen concentration is low is formed in a center region of the flame F by the ammonia injected from the inner tube nozzle 41.

Referring back to FIG. 1, the two-stage combustion air supply unit 5 is connected to the furnace 2 above the burner 4, and supplies two-stage combustion air into the furnace 2. As the two-stage combustion air is supplied by the two-stage combustion air supply unit 5, an unburned portion of the fuel, which has not been burned by the burner 4, is burned by the two-stage combustion air. In this manner, heat collection performance of the boiler 1 can be improved, and the unburned portion of the fuel contained in the exhaust gas can be reduced.

The ammonia supply unit 6 includes an ammonia supply source 6*a*, a fuel ammonia supply part 6*b*, and an ammonia supply control device 6*c*. The ammonia supply source 6*a* includes a tank that stores the ammonia. The ammonia supply source 6*a* may not necessarily be a component of the ammonia supply unit 6. That is, the ammonia supply unit 6 may take in the ammonia from the ammonia supply source 6*a* installed outside.

The fuel ammonia supply part 6*b* includes a fuel ammonia supply pipe 6*b*1 that connects the ammonia supply source 6*a* and the burner 4 to each other, and a flow rate adjustment valve 6*b*2 that is installed in an intermediate part of the fuel ammonia supply pipe 6*b*1. The fuel ammonia supply pipe 6*b*1 guides the ammonia supplied from the ammonia supply source 6*a* to the burner 4. The flow rate adjustment valve 6*b*2 controls a flow rate of the ammonia to be supplied from the ammonia supply source 6*a* to the fuel ammonia supply pipe 6*b*1.

The ammonia supply control device 6*c* controls the flow rate adjustment valve 6*b*2 to adjust an opening degree of the flow rate adjustment valve 6*b*2. The ammonia supply control device 6*c* adjusts the opening degree of the flow rate adjustment valve 6*b*2, based on an external command or the like, thereby controlling the flow rate of the ammonia to be taken in from the ammonia supply source 6*a*.

The pulverized coal supply unit 7 is connected to the burner 4, crushes the coal into the pulverized coal, and supplies the pulverized coal to the burner 4. For example, the pulverized coal supply unit 7 includes a mill that crushes the coal to a particle size of approximately several micrometers to obtain the pulverized coal, and a coal feeder that supplies the pulverized coal produced by the mill to the burner 4. The pulverized coal supply unit 7 may be configured to supply the pulverized coal directly from the mill to the burner 4 without providing the coal feeder.

In the boiler 1 of the present embodiment, for example, the air atmosphere inside the furnace 2 is set to be lower than the theoretical amount of air. Then, the ammonia is supplied from the ammonia supply unit 6 to the burner 4, and the pulverized coal is supplied from the pulverized coal supply unit 7 to the burner 4, thereby forming a flame by the burner 4 using the ammonia and the pulverized coal as a fuel. In addition, the two-stage combustion air is supplied into the furnace 2 by the two-stage combustion air supply unit 5, and the unburned fuel contained in the combustion gas generated by the burner 4 is burned. The combustion gas generated by burning the fuel moves from the lower part to the upper part of the furnace 2, and is guided outward through the flue 3.

In the burner 4 of the present embodiment, by the ammonia injected from the inner tube nozzle 41, the reduction region R2 in which the ammonia concentration is high and the oxygen concentration is low is formed in the center part of the flame F when viewed in the injection direction of the fuel. On the other hand, nitrogen oxides are generated by burning the mixture of the ammonia injected around the inner tube nozzle 41 from the outer tube nozzle 42 and the oxygen, and the generated nitrogen oxides are carried by a circulating flow flowing from an outer edge of the flame F having a relatively high pressure toward a center of the flame F having a relatively negative pressure, and are supplied to the reduction region R2. As a result, the nitrogen oxides generated in the outer edge of the flame F are reduced in the reduction region R2, which is formed by the ammonia injected from the inner tube nozzle 41, to become nitrogen gas ($N_2$). Therefore, according to the burner 4 of the present embodiment, it is possible to suppress an increase in the nitrogen oxides.

Further, the burner 4 of the present embodiment includes the ammonia swirler 45 that is disposed inside the outer tube nozzle 42 and swirls the flow of the ammonia injected around the inner tube nozzle 41. It has been confirmed that, in a case where the ammonia is injected from the outer tube nozzle 42 without swirling, since the temperature of the injected ammonia is lower than the internal temperature of furnace 2, the density of ammonia is high and the injected ammonia is gathered to a lower side due to the weight. On the other hand, as the ammonia is swirled and injected from the outer tube nozzle 42, the ammonia can be evenly distributed in the radial direction centered on the axis L due to the centrifugal force caused by the swirling. Thus, it is possible to prevent the bias of the ammonia concentration around the flame F, and to prevent a possibility that a large amount of nitrogen oxides is locally generated. As a result, it is possible to reduce the amount of nitrogen oxides which do not flow to the reduction region R2, and accordingly it is possible to more reliably suppress an increase in the nitrogen oxides.

Further, the burner 4 of the present embodiment includes the pulverized coal injection nozzle 43 that injects the air containing the pulverized coal around the outer tube nozzle 42 when viewed in the injection direction of the ammonia from the burner 4. Therefore, the burner 4 of the present embodiment can use the pulverized coal as a fuel, in addition to the ammonia, to generate the combustion gas.

Further, the pulverized coal injection nozzle 43 is formed of a single tube structure and guides the air containing the pulverized coal between the pulverized coal injection nozzle 43 and the outer wall surface of the outer tube nozzle 42. Therefore, it is possible to miniaturize the burner 4 compared with a case where the pulverized coal injection nozzle 43 has a double tube structure.

Second Embodiment

Next, a burner 4A included in a burner according to a second embodiment of the present disclosure will be described with reference to FIG. 4. In the description of the present embodiment, the same elements as those of the first embodiment will be omitted or simplified in the description.

Figure 4:
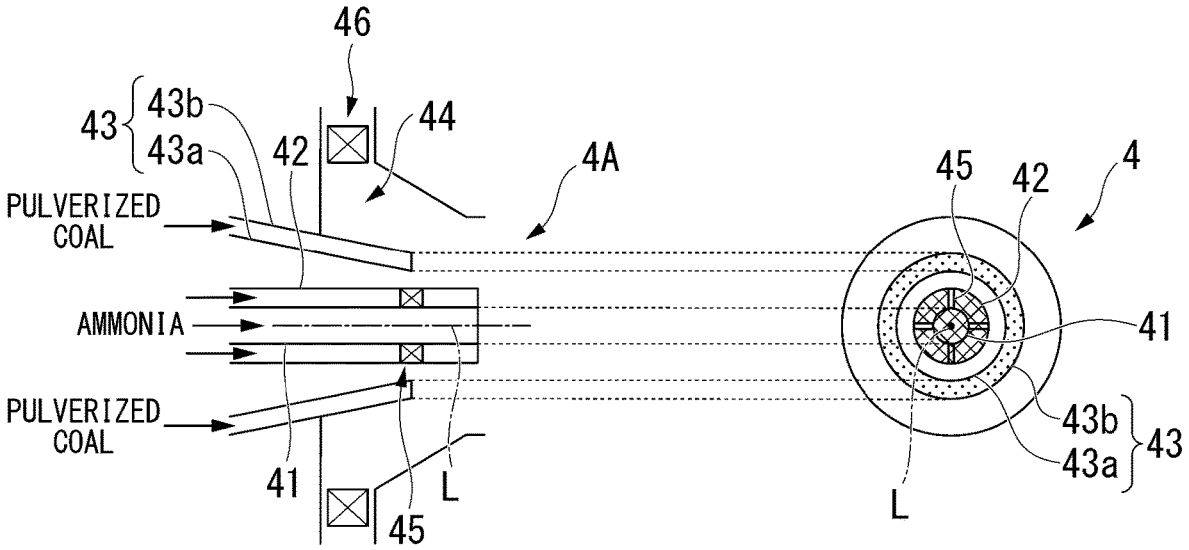
FIG. 4 is a cross-sectional view showing a schematic configuration of a burner included in a boiler according to a second embodiment of the present disclosure.

FIG. 4 is a cross-sectional view showing a schematic configuration of the burner 4A included in the boiler of the present embodiment. As illustrated in FIG. 4, a pulverized coal injection nozzle 43 of the burner 4A of the present embodiment includes an inner tube 43*a* and an outer tube 43*b*. The inner tube 43*a* is provided coaxially with the outer tube nozzle 42 and is disposed to surround the outer tube nozzle 42 from outside in the radial direction when viewed in the injection direction of the ammonia from the burner 4A. The outer tube 43*b* is provided coaxially with the inner tube 43*a* and is disposed to surround the inner tube 43*a* from outside in the radial direction when viewed in the injection direction of the ammonia from the burner 4A. The outer tube 43*b* guides the air containing the pulverized coal between the outer tube 43*b* and the inner tube 43*a*. That is, the pulverized coal injection nozzle 43 of the present embodiment is formed of a double tube structure having the inner tube 43*a* and the outer tube 43*b*.

In the burner 4A of the present embodiment, for example, the pulverized coal injection nozzle 43 can be unitized in advance separately from the inner tube nozzle 41 and the outer tube nozzle 42, and therefore it is possible to facilitate assembly work, maintenance work, and the like for the burner 4A. Further, since the shape, the injection direction, and the like of the pulverized coal injection nozzle 43 can be set independently of the inner tube nozzle 41 and the outer tube nozzle 42, the injection angle of the pulverized coal and the like can be set arbitrarily.

Third Embodiment

Next, a boiler 1A according to a third embodiment of the present disclosure will be described with reference to FIG. 5. In the description of the present embodiment, the same elements as those of the first embodiment will be omitted or simplified in the description.

Figure 5:
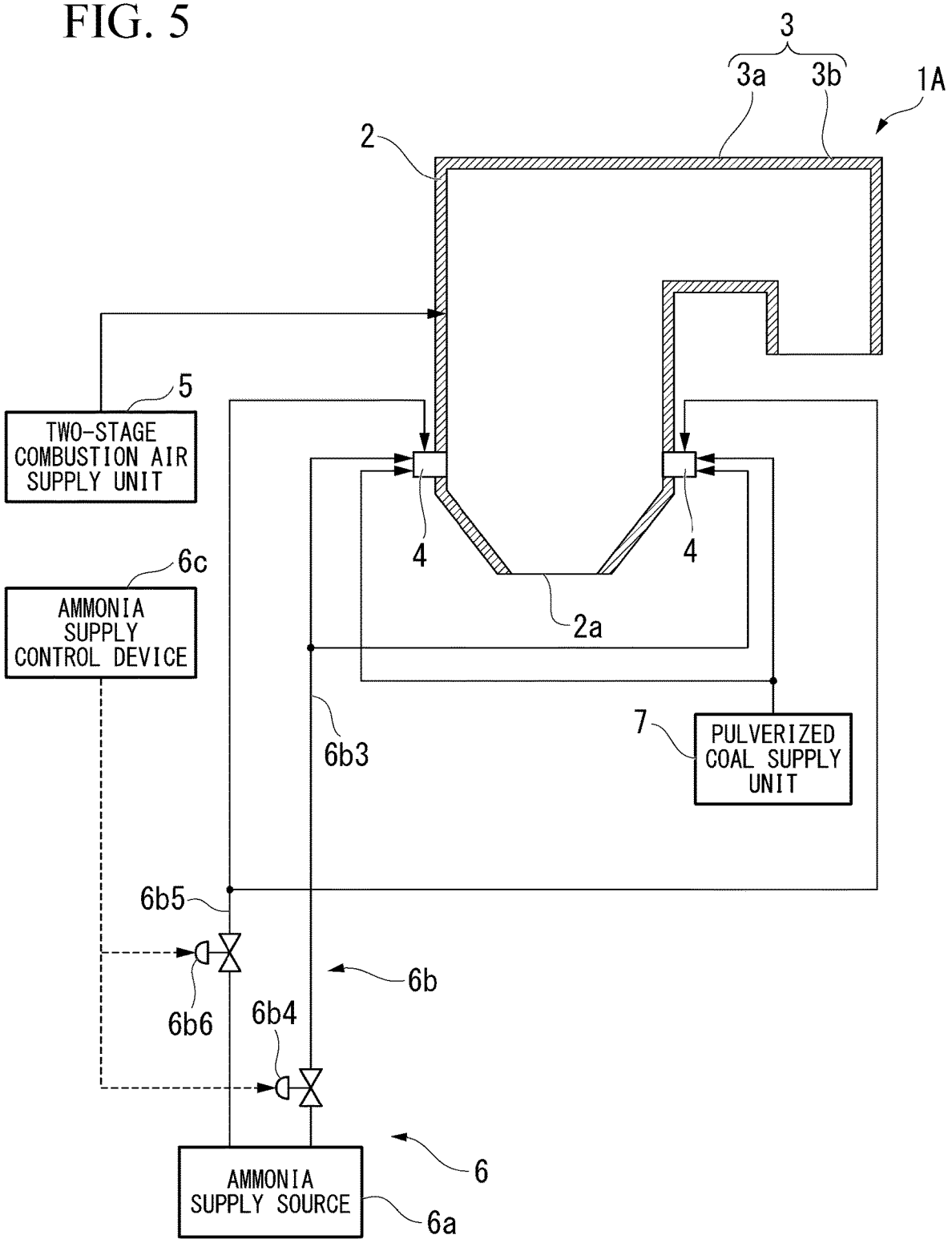
FIG. 5 is a schematic diagram showing a main part configuration of a boiler according to a third embodiment of the present disclosure.

FIG. 5 is a schematic diagram showing a main part configuration of the boiler 1A of the present embodiment. As illustrated in FIG. 5, a fuel ammonia supply part 6*b* of the boiler 1A includes a first pipe 6*b*3 that connects the ammonia supply source 6*a* and the inner tube nozzle 41 of the burner 4 to each other, and a first flow rate adjustment valve 6*b*4 (first flow rate adjustment part) that is installed in an intermediate part of the first pipe 6*b*3. Further, the fuel ammonia supply part 6*b* includes a second pipe 6*b*5 that connects the ammonia supply source 6*a* and the outer tube nozzle 42 of the burner 4 to each other, and a second flow rate adjustment valve 6*b*6 (second flow rate adjustment part) that is installed in an intermediate part of the second pipe 6*b*5.

Further, the ammonia supply control device 6*c* of the present embodiment controls the first flow rate adjustment valve 6*b*4 to adjust an opening degree of the first flow rate adjustment valve 6*b*4. The ammonia supply control device 6*c* controls the second flow rate adjustment valve 6*b*6 to adjust an opening degree of the second flow rate adjustment valve 6*b*6. The first flow rate adjustment valve 6*b*4 is controlled by the ammonia supply control device 6*c* to control a flow rate of the ammonia to be supplied to the inner tube nozzle 41. The second flow rate adjustment valve 6*b*6 is controlled by the ammonia supply control device 6*c* to control a flow rate of the ammonia to be supplied to the outer tube nozzle 42.

According to the boiler 1A of the present embodiment, it is possible to separately control the flow rate of the ammonia to be injected from the inner tube nozzle 41 and the flow rate of the ammonia to be injected from the outer tube nozzle 42 (the ammonia to be injected around the inner tube nozzle 41). Therefore, it is possible to control the flow rate of the ammonia to be injected from the inner tube nozzle 41, without changing the flow rate of the ammonia to be injected from the outer tube nozzle 42, for example such that the ammonia concentration in the reduction region R2 is optimized for the reduction of nitrogen oxides.

Hereinbefore, although embodiments of the present disclosure is described with reference to the attached drawings, the present disclosure is not limited to the above embodiments. The shape, the combination or the like of each component shown in the above embodiment is an example, and various modifications of a configuration based on a design request or the like can be adopted within the scope of the present disclosure.

For example, in the above-described embodiment, the boiler which performs mixed-fuel combustion of the pulverized coal and the ammonia as a fuel has been described. However, the present disclosure is not limited thereto. For example, a configuration may be adopted in which mixed-fuel combustion of natural gas and ammonia is performed, a configuration may be adopted in which mixed-fuel combustion of heavy oil or light oil and ammonia is performed, or a configuration may be adopted in which only ammonia is burned as a fuel. That is, the present disclosure is applicable to a boiler which burns ammonia as a fuel.

Further, in the above-described embodiment, a configuration of including the ammonia swirler 45 has been described. However, the present disclosure is not limited thereto, and a configuration without the ammonia swirler 45 may be adopted.

The present disclosure is applicable to a combustion device and a boiler which burns ammonia as a fuel.

What is claimed is:

1. A boiler comprising:

a furnace;

a combustion device installed in the furnace and configured to inject and burn ammonia as a fuel;

an ammonia supply unit configured to supply the ammonia to the combustion device; and a pulverized coal supply unit configured to supply pulverized coal to the combustion device, wherein the combustion device includes:

an inner tube nozzle disposed in a center part of the combustion device when viewed in an injection direction of the fuel, connected to the ammonia supply unit, and configured to inject the ammonia;

an outer tube nozzle disposed to surround the inner tube nozzle from outside in a radial direction when viewed in the injection direction of the fuel, connected to the ammonia supply unit, and configured to inject the ammonia around the inner tube nozzle such that nitrogen oxides, which are generated by burning a mixture of the ammonia injected from the outer tube nozzle and oxygen, are supplied to a reduction region, which is formed by the ammonia injected from the inner tube nozzle, and the nitrogen oxides are reduced in the reduction region to become nitrogen gas; and a pulverized coal injection nozzle connected to the pulverized coal supply unit and configured to inject air containing the pulverized coal around the outer tube nozzle when viewed in the injection direction of the fuel, a tip end of the inner tube nozzle protrudes farther in the injection direction than a tip end of the outer tube nozzle, and the outer tube nozzle and the pulverized coal injection nozzle each taper towards the tip end of the inner tube nozzle.

2. The boiler according to claim 1, wherein the ammonia supply unit includes:

a first flow rate adjustment part configured to control a flow rate of the ammonia to be supplied to the inner tube nozzle; and a second flow rate adjustment part configured to control a flow rate of the ammonia to be supplied to the outer tube nozzle.

3. The boiler according to claim 1, wherein the combustion device further includes a swirler disposed inside the outer tube nozzle and configured to swirl a flow of the ammonia injected around the inner tube nozzle.

4. The boiler according to claim 1, wherein the pulverized coal injection nozzle is formed of a single tube structure disposed to surround the outer tube nozzle from outside in the radial direction when viewed in the injection direction of the fuel, and configured to guide the air containing the pulverized coal between the pulverized coal injection nozzle and an outer wall surface of the outer tube nozzle.

5. The boiler according to claim 1, wherein the pulverized coal injection nozzle is formed of a double tube structure having an inner tube and an outer tube, the inner tube being disposed to surround the outer tube nozzle from outside in the radial direction when viewed in the injection direction of the fuel, and the outer tube being disposed to surround the inner tube from outside in the radial direction when viewed in the injection direction of the fuel and configured to guide the air containing the pulverized coal between the inner tube and the outer tube.

* * * * *